US005971057A

United States Patent [19]

Yukisawa et al.

[11] Patent Number: 5,971,057

[45] Date of Patent: Oct. 26, 1999

[54] INJECTION MOLDING MACHINE AND INJECTION MOLDING METHOD

[75] Inventors: Saburo Yukisawa; Shinji Akimoto; Tatsuyoshi Miyazaki, all of Toyama-ken, Japan

[73] Assignee: YKK Corporation, Tokyo, Japan

[21] Appl. No.: 09/028,505

[22] Filed: Feb. 24, 1998

[30] Foreign Application Priority Data

Feb. 25, 1997 [JP] Japan ..... 9-058532

[51] Int. Cl.[6] ..... B22D 17/04

[52] U.S. Cl. ..... 164/113; 164/316

[58] Field of Search ..... 164/457, 155.4, 164/154.2, 113, 312, 316, 317, 318

[56] References Cited

FOREIGN PATENT DOCUMENTS 628993 10/1978 Russian Federation ..... 164/318

*Primary Examiner*—Kuang Y. Lin

*Attorney, Agent, or Firm*—Hill & Simpson

[57] ABSTRACT

An injection molding machine having a simple structure and adapted to quickly produce molded products without significant flaws on the surface is provided. It comprises a plunger being adapted to introduce the molten metal into the cylinder section, a nozzle for injecting the molten metal fed from the plunger into a metal mold and a piston arranged within a cylinder section of the plunger to slidingly reciprocate. It includes a piston drive unit for driving the piston to slidingly reciprocate, a stopper member for controlling the retracted position of the piston drive unit and a position selecting unit for defining a projected position and a retracted position for the stopper member.

1 Claim, 9 Drawing Sheets

INJECTION MOLDING MACHINE AND INJECTION MOLDING METHOD

BACKGROUND OF THE INVENTION

1. Field of the Invention

This invention relates to an injection molding machine for molding a product having a desired profile by injecting molten metal into a metal mold by means of a plunger, and an injection molding method for molding such a product.

2. Prior Art

FIGS. 8A and 8B of the accompanying drawings illustrate a typical known metal molding machine comprising a melting pot (not shown) for storing molten metal 10' and a plunger 12' having a lower portion dipped into the molten metal 10' in the melting pot, wherein the molten metal 10' is fed from the plunger 12' to an injection nozzle 14' and then injected into a metal mold 16'. The plunger 12' has a cylinder section 18' dipped into the molten metal 10' and a piston 20' that slidingly reciprocates within the cylinder section 18', which cylinder section 18' has a through hole 22' bored through an upper portion of its lateral wall, through which the molten metal 10' is drawn into the cylinder section 18'. A rod 24' is linked to the piston 20' at an end thereof and to a corresponding rod 28' of another piston 30' housed in a hydraulic cylinder 26' at the other end.

The illustrated known injection molding machine operates in a manner as described below. Firstly as shown in FIG. 8A, the piston 30' of the hydraulic cylinder 26' is raised to pull up the piston 20' of the plunger 12' above the through hole 22' by way of the rods 24' and 28'. Since the through hole 22' is located below the surface L' of the molten metal 10', the molten metal 10' flows into the cylinder section 18'. Subsequently, the piston 30' of the hydraulic cylinder 26' is moved downward to lower the piston 20' of the plunger 12', and after the piston 20' passes the through hole 22', the molten metal 10' is forced in the cylinder section 18' to move out toward the nozzle 14' until it is injected into a cavity of the metal mold 16' through the outlet of the nozzle 14'. When the metal in the metal mold 16' is solidified, the metal mold 16' is opened to take out the molded product. Thereafter the piston 30' of the hydraulic cylinder 26' is raised to pull up the piston 20' of the plunger 12' as shown in FIG. 8B. Then, the molten metal 10' in the cylinder section 18' moves back from the nozzle 14' as the piston 20' is pulled up, and once the piston 20' passes by the through hole 22', falls until its surface is flush with the level L' of the surface of the molten metal 10' in the melting pot because the inside of the plunger 12' is subjected to the atmospheric pressure.

With the above described prior art metal mold machine, the molten metal 10' in the nozzle 14' is forced to move back and forth in each injection molding cycle between the nozzle tip and the level L' of the molten metal in the melting pot to cover a relatively long traveling distance so that the molten metal 10' can take in bubbles to a large extent at the time of injection. Additionally, a long traveling distance means a long injection molding cycle time and a low efficiency.

There has been proposed an injection molding machine, as shown in FIGS. 9A and 9B, that provides an improvement to the above described known machine by arranging, in addition to the features of the machine of FIGS. 8A and 8B, a non-return valve 34' at the bottom of the cylinder section 18' so that molten metal 10' can flow from the melting pot into the cylinder section 18' but cannot flow back from the cylinder section 18' and hence the molten metal 10' is inevitably moved through the injection path 15' and injected through the nozzle 14'.

However, with this arrangement, the molten metal 10' can remain in the injection path 15' all the way to the tip of the nozzle 14' to deter the initial rate of injecting the molten metal in the next injection molding cycle so that the molded products may show flaws on the surface.

In view of the above identified technological problems, it is therefore an object of the present invention to provide an injection molding machine having a simple structure and adapted to operate for injection molding with a short cycle time so that the molded products show an improved surface. Another object of the invention is to provide an injection molding process using such a machine.

SUMMARY OF THE INVENTION

According to the invention, the above object is achieved by providing an injection molding machine comprising a plunger, a nozzle for injecting molten metal fed from the plunger into a metal mold and a piston arranged within the cylinder section of the plunger to slidingly reciprocate. The machine is characterized in that it includes a piston drive unit such as a hydraulic cylinder for driving the piston to slidingly reciprocate, a stopper member for controlling the retracted position of the piston drive unit and a position selecting unit for defining a projected position and a retracted position for the stopper member. Preferably, the injection molding machine according to the invention additionally includes a change-over valve for changing the direction of hydraulic pressure in accordance with the sliding stroke of the piston. The means for introducing the molten metal into the cylinder section may comprise a through hole and a non-return valve arranged in the bottom of the cylinder or a through hole bored through the lateral wall of the cylinder and a non-return valve arranged in the piston. The machine also includes a position regulating member for controlling the retracted position of the stopper member.

With the injection molding machine of the invention, there is also provided an injection molding method comprising steps of lowering the piston to inject the molten metal from the inside of the cylinder through the nozzle, causing the stopper member to project into the piston drive unit by means of the position selecting unit and to stop the retreating piston at a predetermined position by abutting with a moving portion of the piston drive unit, introducing the molten metal into the cylinder section by way of the non-return valve, opening the metal mold to take out a molded product under this condition, subsequently retracting the stopper member by means of said position selecting unit and allowing the piston to move upward to cause the molten metal in the plunger to retreat to an intermediate position slightly behind said nozzle for the next injection molding cycle.

DETAILED DESCRIPTION OF THE PREFERRED EMBODIMENT

Figure 6:
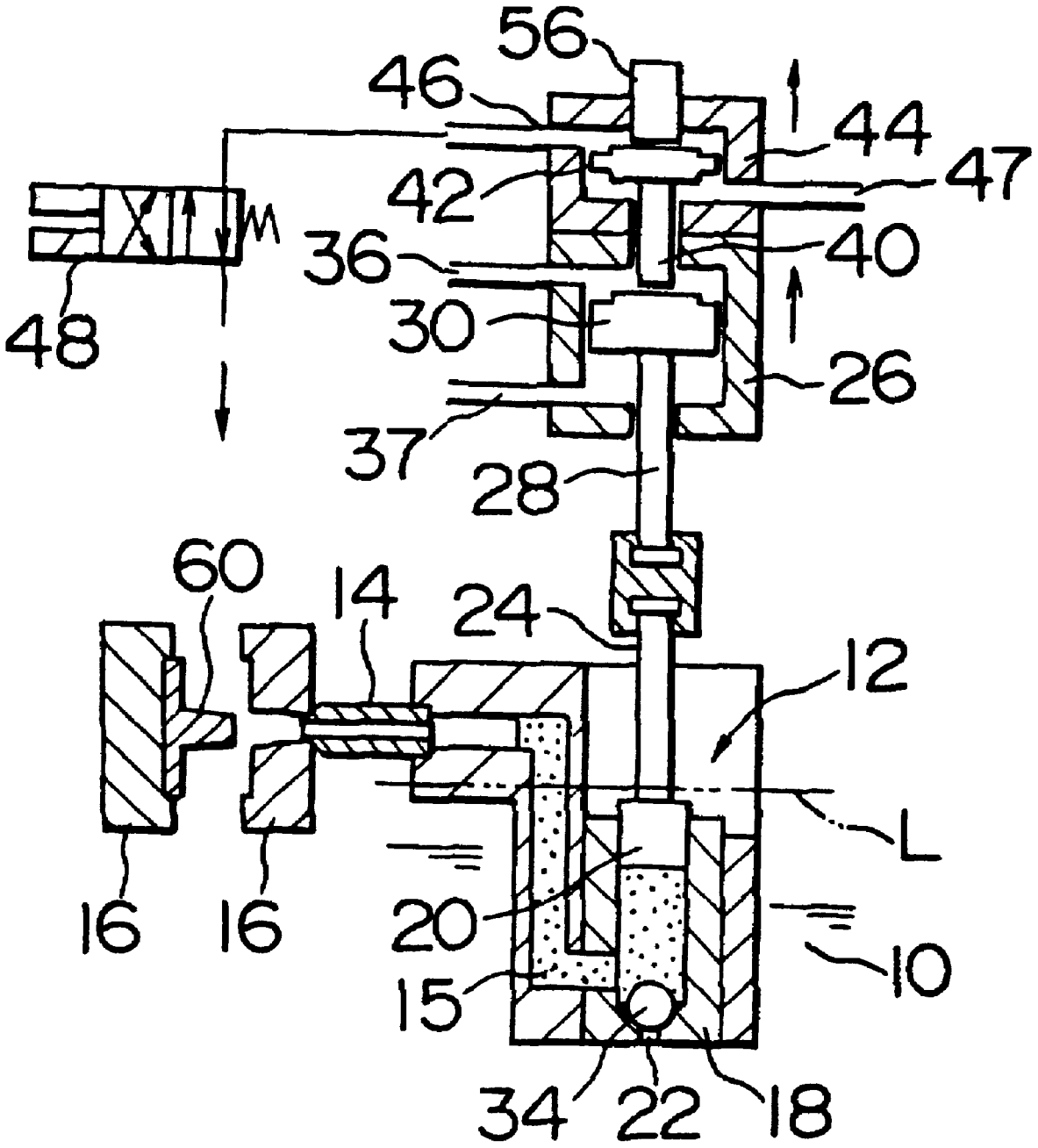
FIG. 6 is a schematic cross sectional view of the embodiment of injection molding machine according to the invention, showing the molding step that follows the step of FIG. 5.
Figure 7:
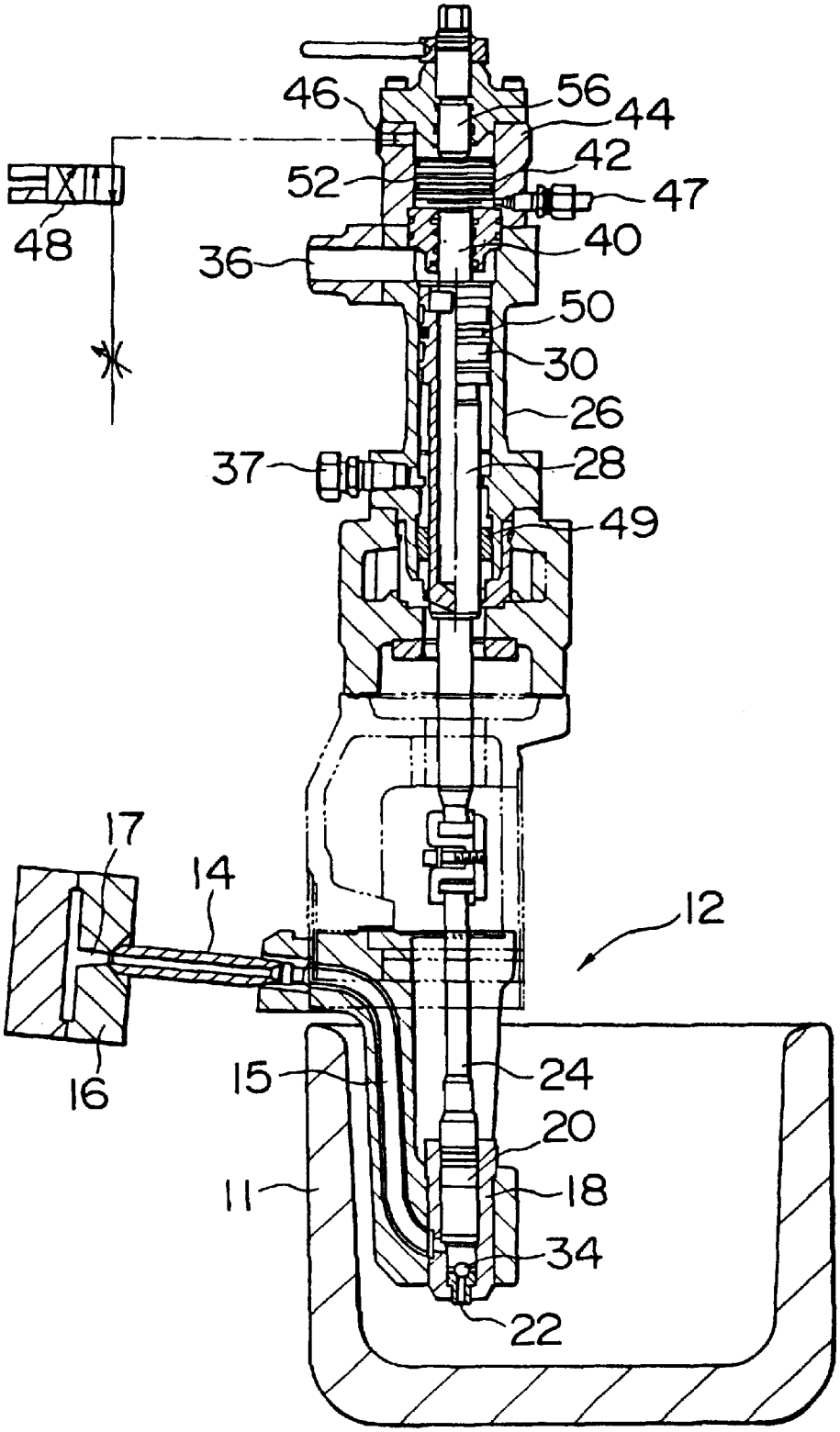
FIG. 7 is a schematic cross sectional view of an embodiment of injection molding machine according to the invention.
Figure 8A:
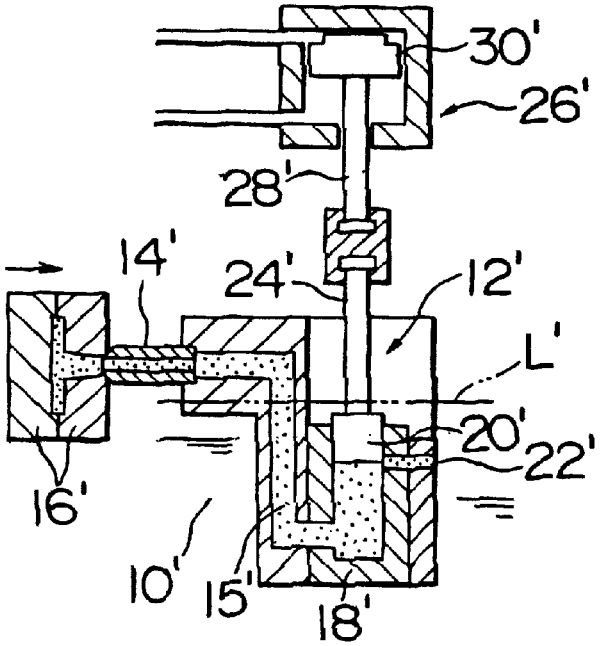
FIG. 8A PRIOR ART
FIGS. 8A and 8B are schematic longitudinal cross sectional views of a known injection molding machine, showing molding steps.
Figure 8B:
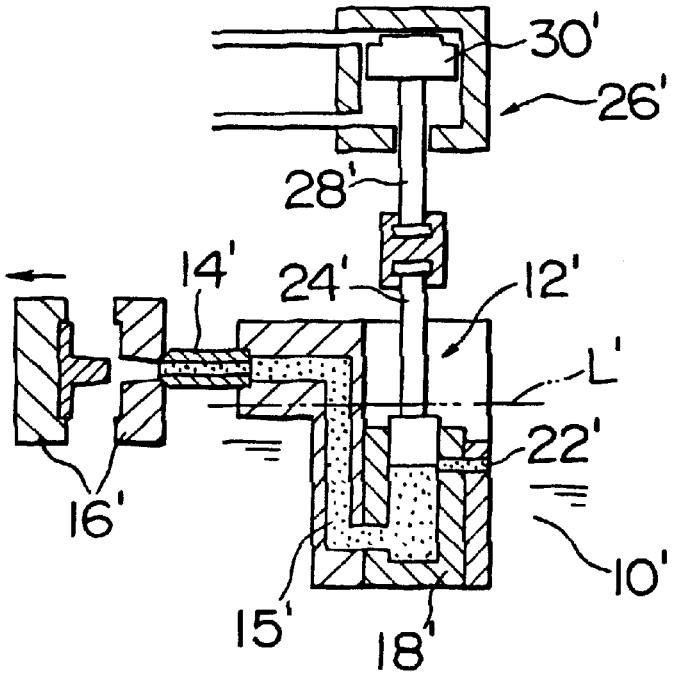
FIG. 8B PRIOR ART
Figure 9A:
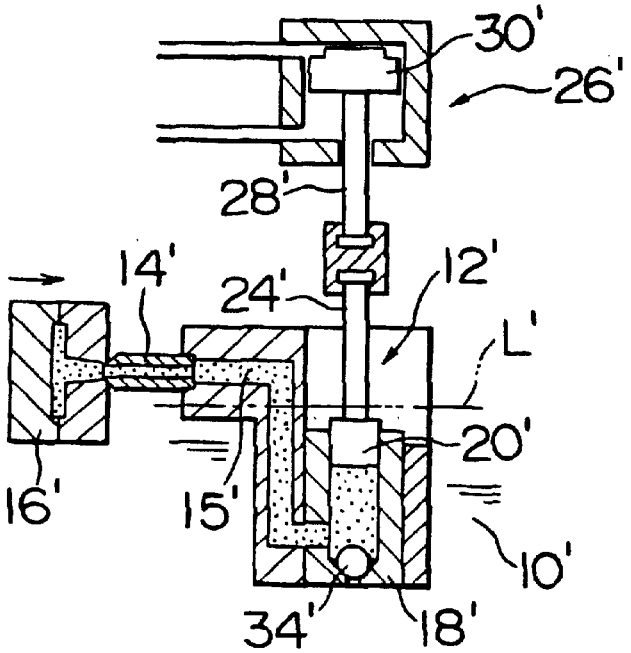
FIG. 9A PRIOR ART
FIGS. 9A and 9B are schematic longitudinal cross sectional views of another known injection molding machine, showing molding steps.
Figure 9B:
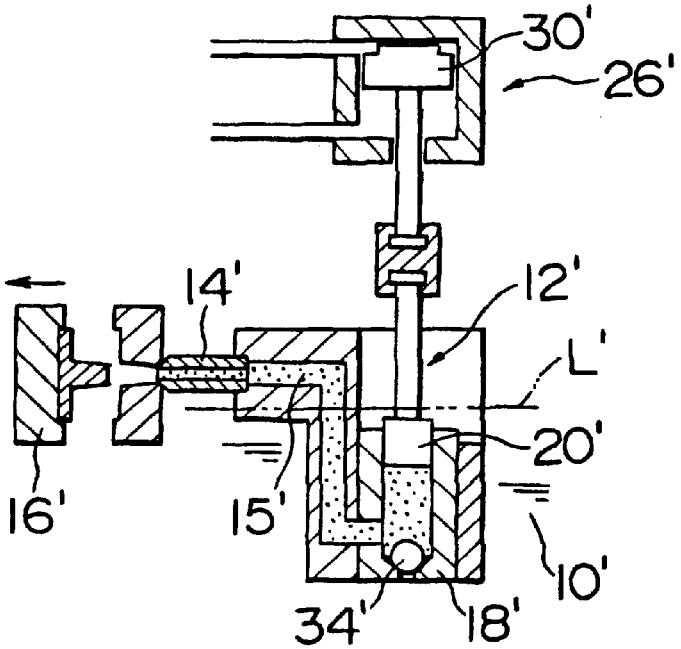
FIG. 9B PRIOR ART

Now, the present invention will be described by referring to FIGS. 1 through 7 that illustrate an embodiment of the invention. As shown in FIG. 7, an injection molding machine is designed for injection molding of molten metal 10 such as zinc and comprises a melting pot (not shown) for storing molten metal 10 and a plunger 12 having a lower half dipped into the molten metal 10 in the melting pot. The plunger 12 has an injection path 15 for feeding molten metal 10 to an injection nozzle 14 arranged at the front end of the injection path 15 and linked to an injection port 17 of a metal mold 16.

The plunger 12 comprises a cylinder section 18 dipped into molten metal 10 and a piston 20 adapted to slidingly reciprocate within the cylinder 18. A through hole 22 is bored through the bottom of the cylinder 18 to feed the molten metal 10 into the cylinder section 18 and a non-return valve 34 is arranged in the through hole 22 at a position close to the inside of the cylinder section 18.

A rod 24 is secured to the piston 20 at an end thereof and linked at the opposite end to another rod 28 of another piston 30 of a hydraulic cylinder 26 located above the plunger 12 for driving the piston 30. The hydraulic cylinder 26 is adapted to be fed with and deliver hydraulic oil by way of ports 36 and 37 located above and below the piston 30 respectively.

A rod-shaped stopper member 40 is arranged up in the hydraulic cylinder 26 for controlling the raised position of the piston 30, namely the retracted position of the piston 20. The stopper member 40 is secured at an end thereof to a piston 42 of a hydraulic cylinder 44. The hydraulic cylinder 44 operates as a position selecting unit for holding the stopper member 40 to the projected position or the retracted position. Hydraulic pressure is applied to the hydraulic oil ports 46, 47 of the hydraulic cylinder 44 by way of a piping system (not shown) and a solenoid valve 48 that is a change-over valve for controlling the operation of the hydraulic cylinder 44 is arranged in the piping system.

Referring to FIG. 7, a bush 49 intervenes between the rod 28 and the hydraulic cylinder 26 in order to prevent oil from leaking and a sealing member 50 is fitted to the piston 30 so as to be in contact with the cylinder wall surface. Another sealing member 52 is fitted to the piston 42 also in order to prevent oil from leaking. A position regulating member 56 is positionally adjustably projecting from the top of the hydraulic cylinder 44 to control the top position of the piston 42.

Figure 1:
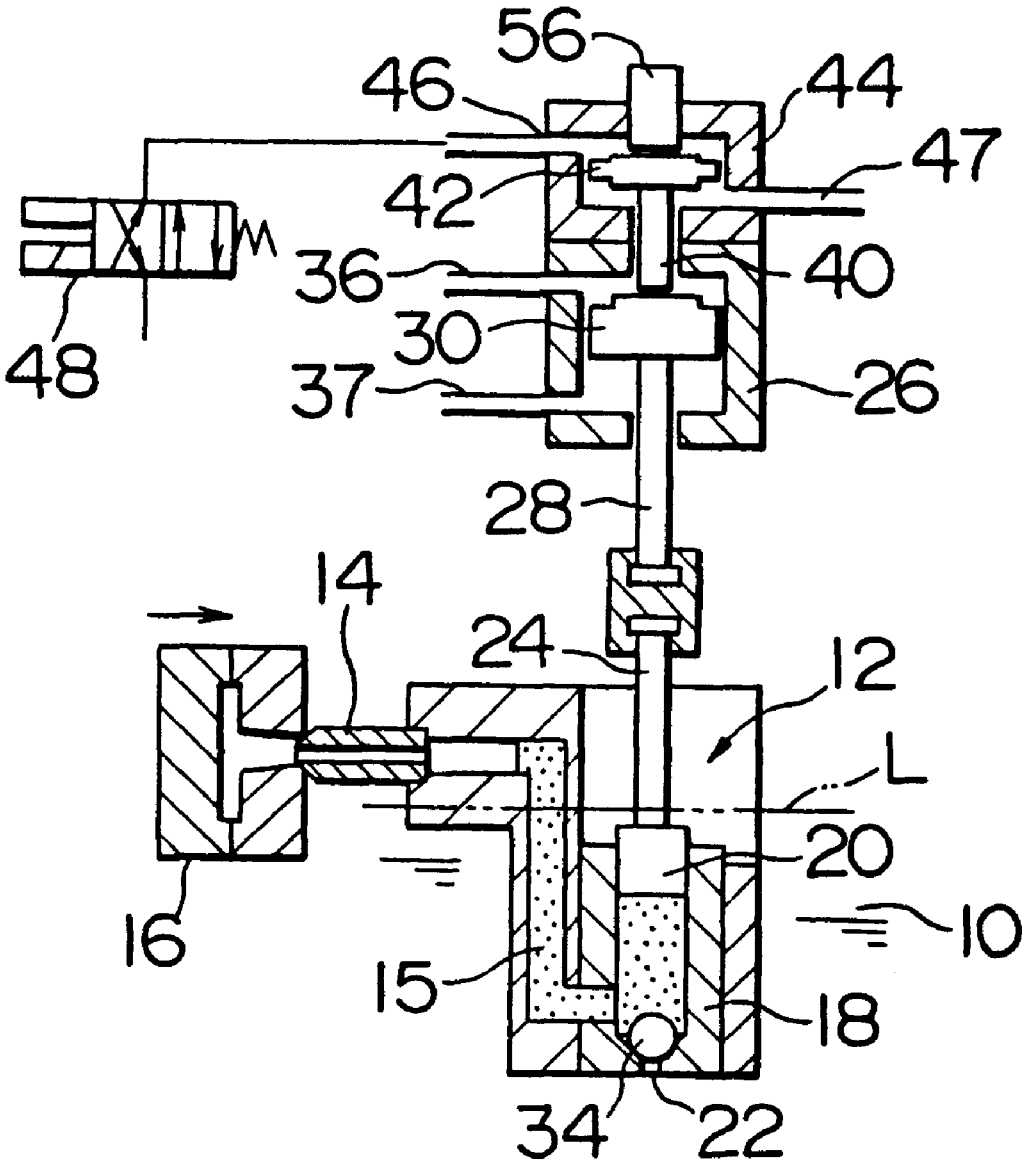
FIG. 1 is a schematic cross sectional view of an embodiment of injection molding machine according to the invention, showing a molding step.
Figure 2:
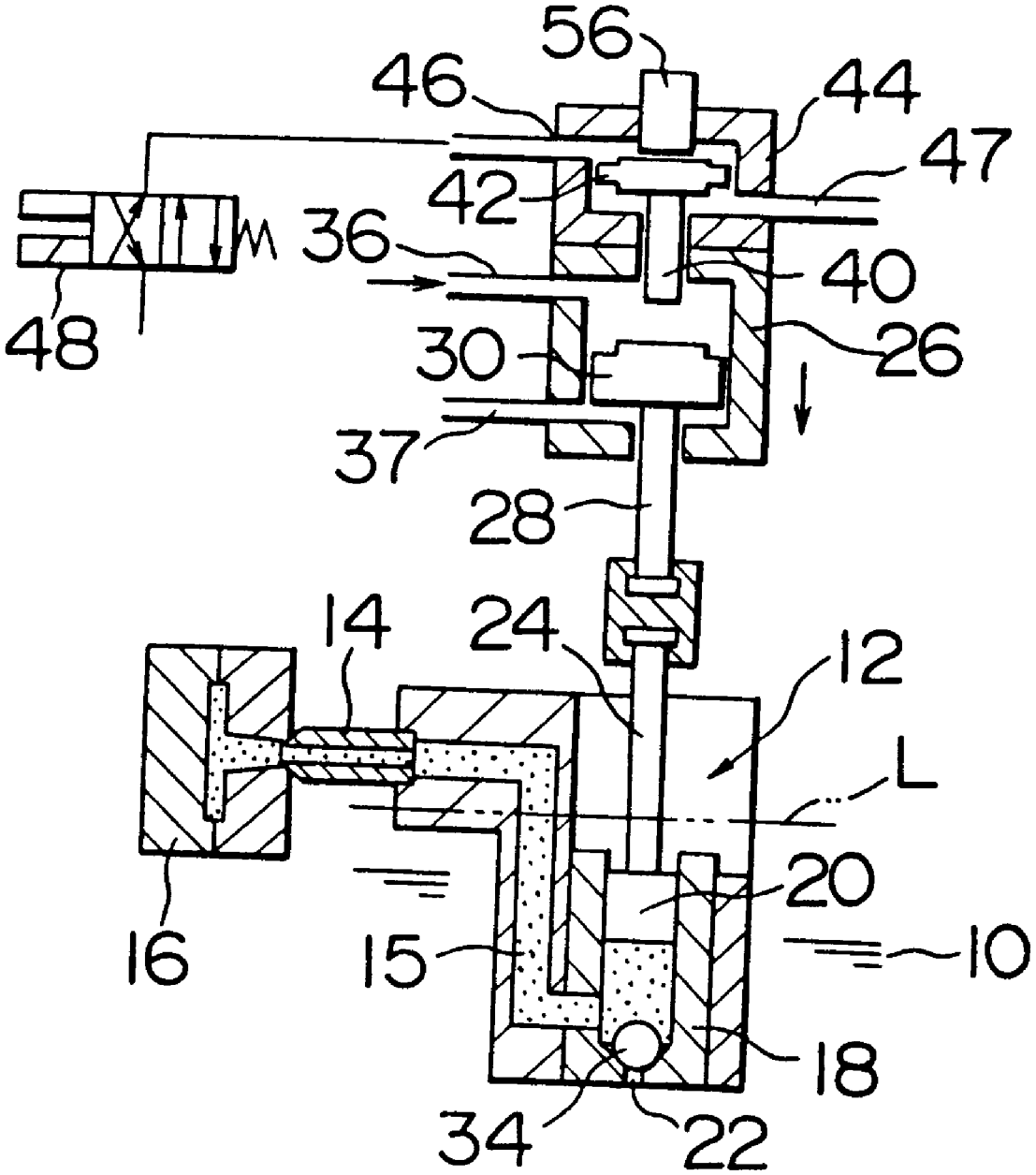
FIG. 2 is a schematic cross sectional view of the embodiment of injection molding machine according to the invention, showing the molding step that follows the step of FIG. 1.

The above described embodiment of injection molding machine operates in a manner as will be described below. Firstly, as shown in FIG. 1, as the piston 20 is raised, the molten metal 10 flows into the cylinder section 18 by way of the through hole 22 and the non-return valve 34 until the inside of the cylinder section 18 is filled with molten metal 10. Then, referring to FIG. 2, hydraulic pressure is applied to the hydraulic cylinder 26 to lower the piston 30 and then the piston 20 by way of the rods 28, 24. Since the non-return valve 34 is closed under this condition, the molten metal 10 can be injected into the metal mold 16 by way of the injection path 15.

Figure 3:
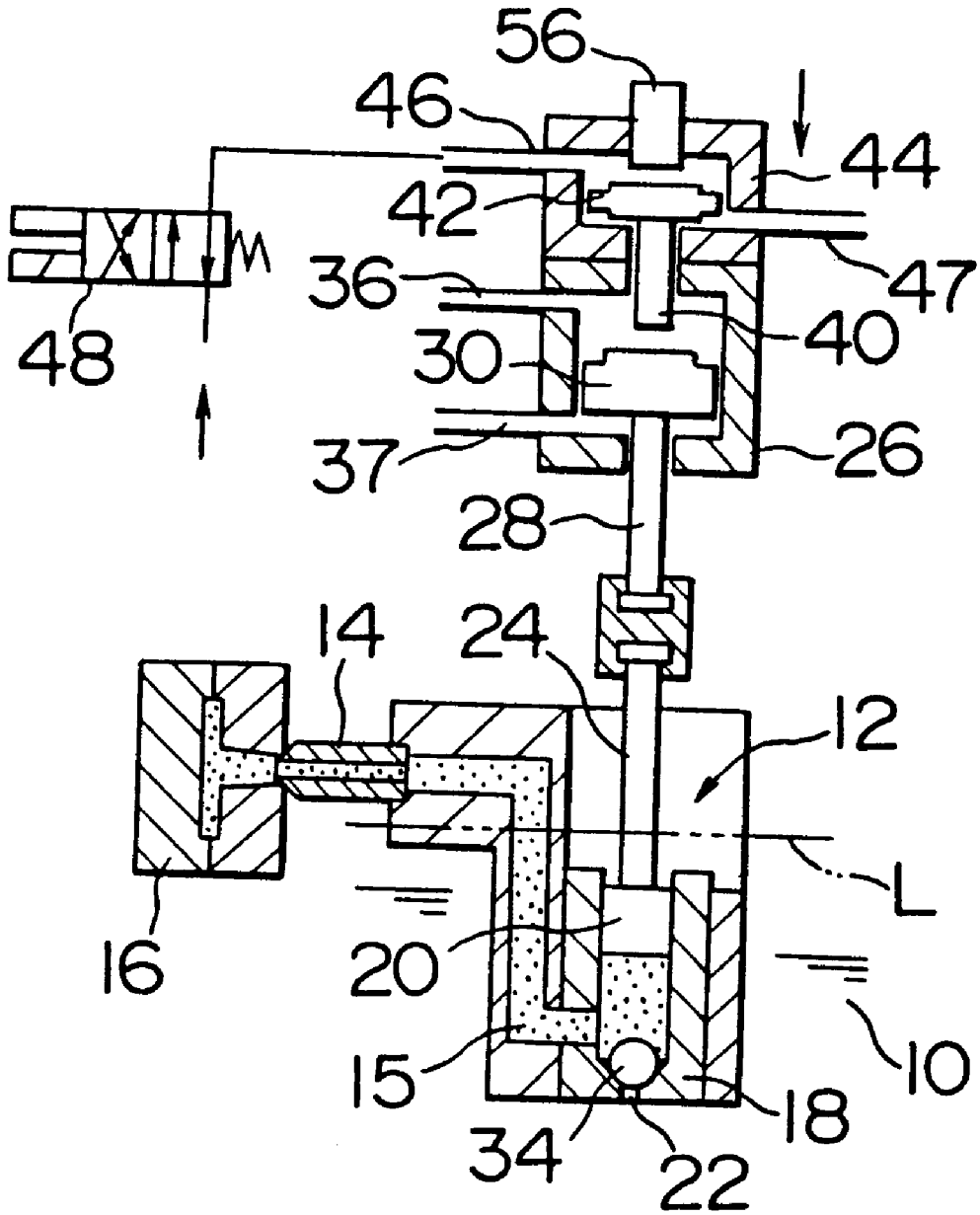
FIG. 3 is a schematic cross sectional view of the embodiment of injection molding machine according to the invention, showing the molding step that follows the step of FIG. 2.
Figure 4:
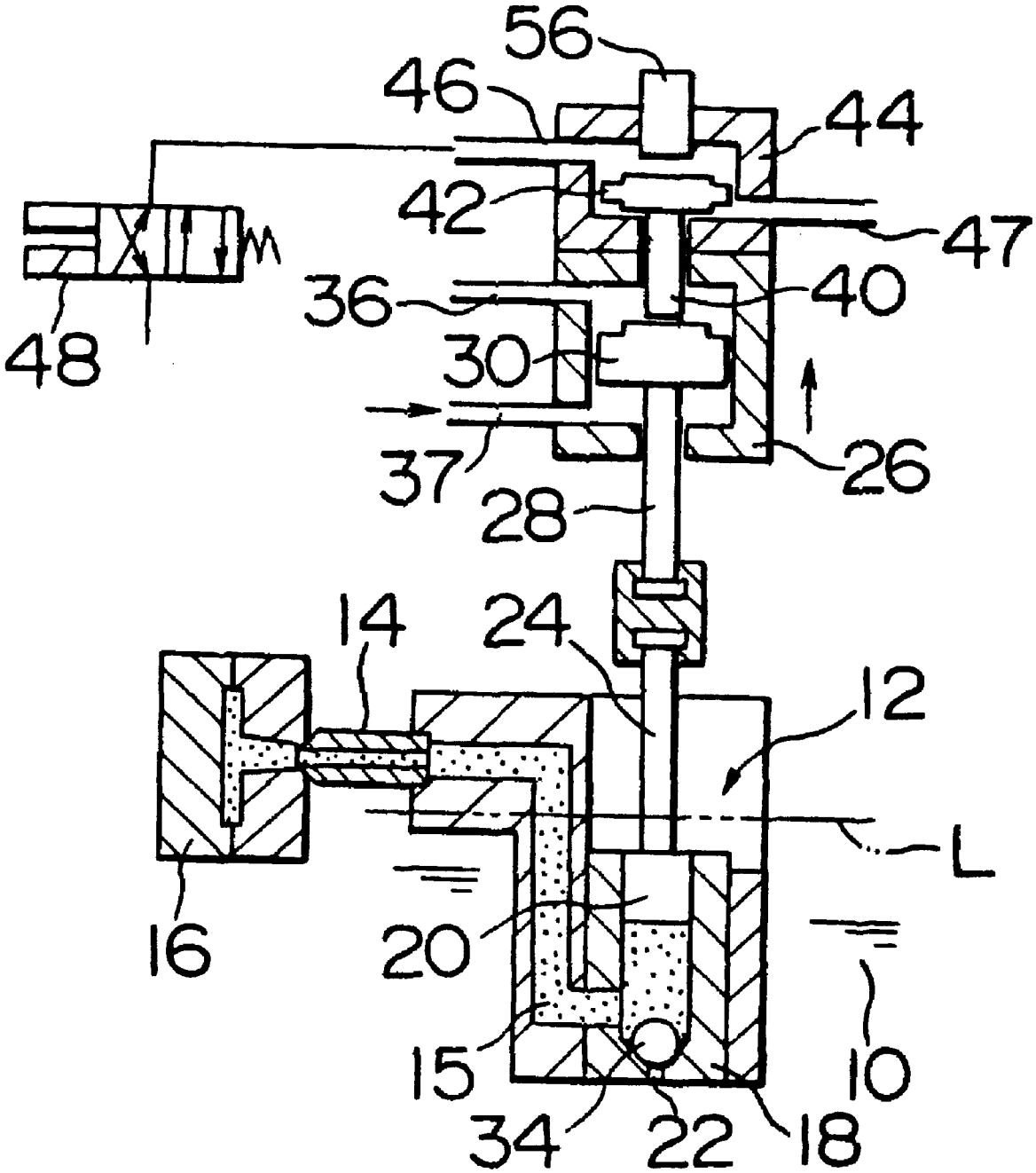
FIG. 4 is a schematic cross sectional view of the embodiment of injection molding machine according to the invention, showing the molding step that follows the step of FIG. 3.

After the injection, the solenoid valve 48 is switched to apply hydraulic pressure to the hydraulic cylinder 44 and lower the piston 42 until the stopper 40 projects into the hydraulic cylinder 26 as shown in FIG. 3. Thereafter, the piston 30 is raised until it abuts the stopper 40 by applying hydraulic pressure by way of the port 37 of the hydraulic cylinder 26 as shown in FIG. 4. As a result, the piston 20 is in a slightly raised position so that the molten metal 10 can flow into the cylinder section 18 via the through hole 22 and the non-return valve 34 to partly fill the inside of the cylinder section 18.

Figure 5:
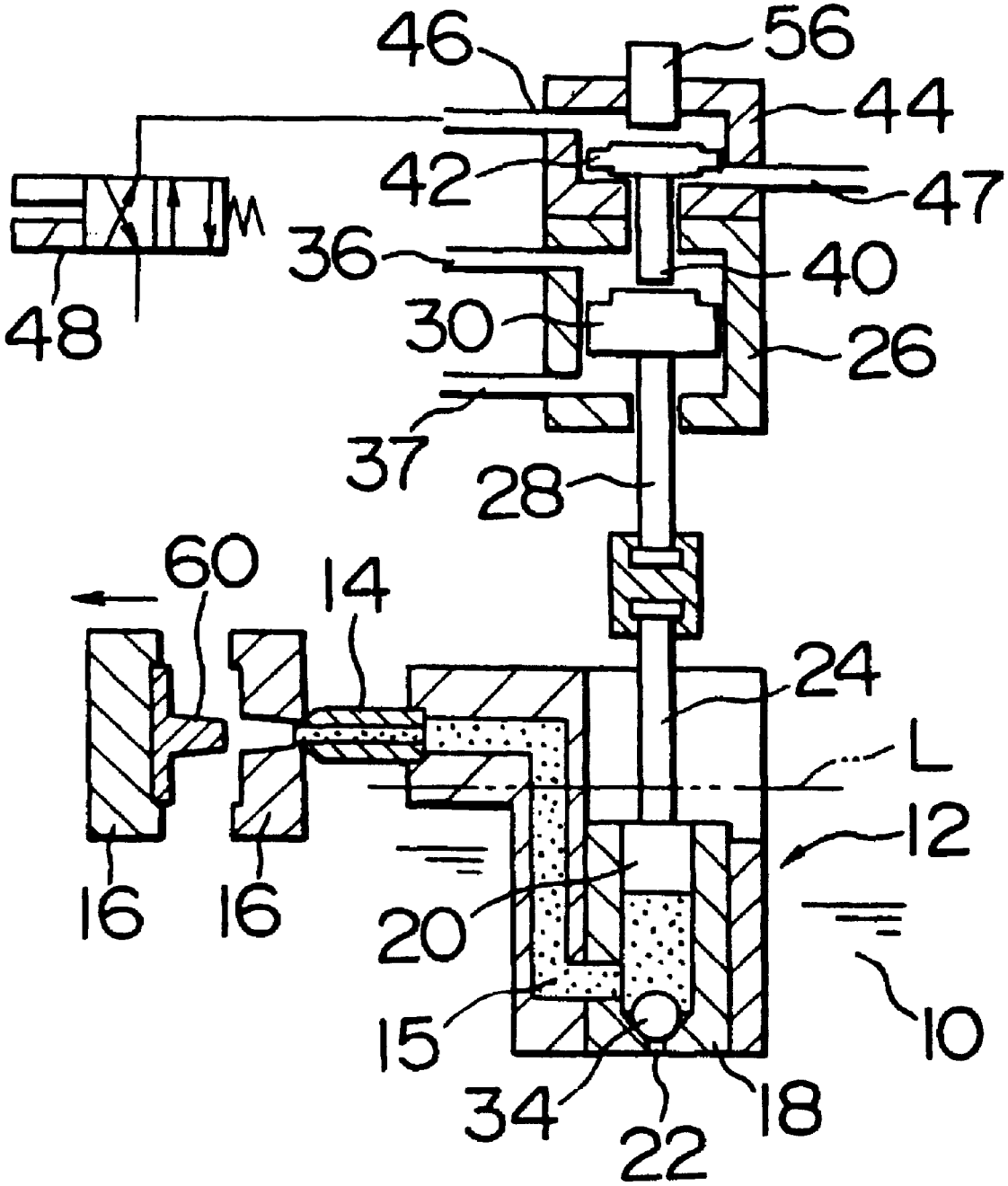
FIG. 5 is a schematic cross sectional view of the embodiment of injection molding machine according to the invention, showing the molding step that follows the step of FIG. 4.

The movable half of the metal mold 16 is opened when the injected metal is cooled sufficiently and a molded product 60 is taken out as shown in FIG. 5. Subsequently, the solenoid valve 48 is switched to apply hydraulic pressure to the hydraulic cylinder 44 via the port 47 and the piston 42 is raised as shown in FIG. 6. At the same time, the piston 20 is raised so that the molten metal 10 in the injection path 15 retreats from the nozzle 14 by a distance as much as the piston 20 is raised. The distance of the retreat also corresponds to the retracting stroke of the stopper 40 after molten metal 10 is preliminarily introduced into the cylinder section 18, so that the molten metal 10 there does not get to the surface level L of the molten metal 10 in the melting pot. The retracting stroke of the stopper 40 can be regulated by adjusting the projected position of the position regulating member 56 so that front end of the molten metal 10 in the cylinder section 16 retreats to a selected position.

With the above described embodiment of injection molding machine and the injection molding method, the front end of the molten metal 10 to be injected can be held to the selected position by regulating the retracted position of the stopper 40 so that the front end of the molten metal to be injected can be held to a position by which the rate of injecting molten metal can be raised significantly and which is optimal for minimizing air bubbles that can be taken into the molded product. Thus the injection molding by which the quality of the surface and manufacturing rate of the product are excellent can be realized.

It should be noted that the structure and the method of regulating the retracting motion of the molten metal injecting piston may be appropriately selected so long as the retracting motion of the piston can be regulated stepwise. Additionally, a plunger having a structure different from that of the above embodiment may alternatively be used. For example, the through hole for introducing molten metal may be bored through the lateral wall of the cylinder section and a non-return valve may be arranged within the piston in such a way that the molten metal can flow downward in the piston within the cylinder section but not upward nor sideways in the piston.

Thus, an injection molding machine according to the invention can inject molten metal 10 at a considerably high rate with a short injection distance to efficiently produce molded products without significant flaws on the surface.

The injection molding method according to the invention can regulate the distance by which the molten metal 10 in the plunger 12 retreats from the nozzle 14 in order to inject molten metal 10 under optimal conditions and efficiently produce molded products without significant flaws on the surface.

What is claimed:

1. An injection molding method adapted to employ a molten metal injection molding machine comprising a nozzle flow connected to a cylinder section and to a metal mold, a piston slidingly reciprocating in the cylinder section, a piston drive unit driving said piston to slidingly reciprocate, a stopper member controlling the retracted position of said piston drive unit and a position selecting unit defining a projected position and a retracted position for the stopper member, said method comprising the steps of:

(a) lowering said piston and injecting the molten metal from the inside of the cylinder section through the nozzle;

(b) projecting said stopper member into the piston drive unit by said position selecting unit;

(c) retracting said piston;

(d) stopping said retracting piston at a predetermined position by abutting with said piston drive unit;

(e) introducing the molten metal into the cylinder section and partially filling the cylinder section;

(f) subsequently opening said metal mold and removing a molded product;

(g) retracting said stopper member by said position selecting unit; and (h) allowing the piston to move upward and retreating the molten metal in the injection path by a predetermined distance for the next injection molding cycle.

* * * * *